United States Patent [19]

Maglica

[11] Patent Number: 4,577,263

[45] Date of Patent: Mar. 18, 1986

[54] MINIATURE FLASHLIGHT

[76] Inventor: Anthony Maglica, 219 Armsluy Sq., Ontario, Calif. 91762

[21] Appl. No.: 648,032

[22] Filed: Sep. 6, 1984

[51] Int. Cl.[4] ..... F21L 7/00

[52] U.S. Cl. ..... 362/187; 362/205; 362/197

[58] Field of Search ..... 362/205, 187, 197, 194, 362/203

[56] References Cited

U.S. PATENT DOCUMENTS

| | | | |
|---|---|---|---|
| 2,339,356 | 1/1944 | Sachs | 362/187 |
| 2,599,295 | 6/1952 | Thomas | 362/205 |
| 2,915,621 | 12/1959 | Garland | 362/205 |
| 2,931,005 | 3/1960 | Saurwein | 362/205 |
| 4,286,311 | 8/1981 | Maglica | 362/205 |
| 4,388,673 | 6/1983 | Maglica | 362/205 |
| 4,429,351 | 1/1984 | Petzl | 362/187 |
| 4,472,766 | 9/1984 | Hung | 362/205 |

*Primary Examiner*—Ronald B. Cox

*Attorney, Agent, or Firm*—Spensley Horn Jubas & Lubitz

[57] ABSTRACT

A miniature flashlight comprising a barrel, a tail cap, a head assembly, and a miniature bulb holder and providing interruptible contact to batteries within the barrel. The bulb holder comprises an insulated receptacle disposed external to the barrel end which the head assembly engages, a second insulated receptacle within the barrel engaging the first insulated receptacle enabling the first and second insulated receptacles to translate axially and limited by a flange on the first insulated receptacle and an annular lip formed inwardly at the barrel end, and a pair of conductors mounted in the second insulated receptacle such that one of the conductors couples the center electrode of a battery with the first bulb pin and the other conductor member couples the second bulb pin to the barrel lip. A spring fits between the tail cap and the batteries. The electrical circuit is closed by the barrel, the tail cap, and the spring to couple the second lamp pin to the battery case terminal. By threading the head assembly onto the barrel causing head assembly translation towards the tail cap, the reflector moves with respect to the bulb varying dispersion of the reflected lamp beam. Further rotation of the head assembly causes the reflector to contact the first insulated receptacle, translating the first insulated receptacle, the second insulated receptacle, and the batteries against the spring, until the first insulated receptacle flange abuts the barrel end, whereat the side conductor no longer contacts the barrel lip opening the circuit. The head assembly may be removed from the barrel and utilized as a base into which the tail cap and barrel may be inserted to stand the miniature flashlight, in its "on" condition, for use as a miniature table lamp.

4 Claims, 8 Drawing Figures

MINIATURE FLASHLIGHT

BACKGROUND OF THE INVENTION

1. Field of the Invention.

The present invention relates primarily to flashlights, and in particular, to a miniature handheld flashlight.

2. Discussion of the Prior Art.

Flashlights of varying sizes and shapes are well-known in the art. In particular, certain of such known flashlights utilize two or more dry cell batteries, carried in series in a cylindrical tube serving as a handle for the flashlight, as their source of electrical energy. Typically, an electrical circuit is established from one electrode of the battery through a conductor to a switch, then through a conductor to one electrode of the lamp bulb. After passing through the filament of the lamp bulb, the electrical circuit emerges through a second electrode of the lamp bulb in electrical contact with a conductor, which in turn is in electrical contact with the flashlight housing. The flashlight housing provides an electrical conduction path to an electrical conductor, generally a spring element, in contact with the other electrode of the battery. Actuation of the switch to complete the electrical circuit enables electrical current to pass through the filament, thereby generating light which is typically focused by a reflector to form a beam of light.

The production of light from such flashlights has often been degraded by the quality of the reflector utilized and the optical characteristics of any lens interposed in the beam path. Moreover, intense light beams have often required the incorporation of as many as seven dry cell batteries in series, thus resulting in a flashlight having significant size and weight.

Efforts at improving such flashlights have primarily addressed the quality of the optical characteristics. The production of more highly reflective, well-defined reflectors, which may be incorporated within such flashlights, have been found to provide a more well-defined focus thereby enhancing the quality of the light beam produced. Additionally, several advances have been achieved in the light admitting characteristics of flashlight lamp bulbs..

Since there exists a wide variety of uses for hand-held flashlights, the development of the flashlight having a variable focus, which produces a beam of light having a variable dispersion, has been accomplished. However, such advances have heretofore been directed at "full-sized" flashlights.

SUMMARY OF THE INVENTION

It is a primary object of the present invention to provide a miniature hand-held flashlight having improved optical characteristics.

It is another object of the present invention to provide a miniature hand-held flashlight which is capable of producing a beam of light having a variable dispersion.

It is a further object of the present invention to provide a miniature hand-held flashlight which is capable of supporting itself vertically on a horizon surface to serve as an "ambient" unfocused light source.

It is another object of the present invention to provide a miniature hand-held flashlight wherein relative motions of components that produce the variation and the dispersion of the light beam provide an electrical switch function to open and complete the electrical circuit of the flashlight.

These and other objects of the present invention, which may become obvious to those skilled in the art through the hereinafter detailed description of the invention are achieved by a miniature flashlight comprising: a cylindrical tube containing at least two miniature dry cell batteries disposed in a series arrangement, a lamp bulb holder assembly including electrical conductors for making electrical contact between terminals of a miniature lamp held therein and the cylindrical tube and an electrode of the battery, respectively, retained in one end of the cylindrical tube adjacent the batteries, a tail cap and spring member enclosing the other end of the cylindrical tube and providing an electrical contact to the other electrode of the batteries, and a head assembly including a reflector, a lens, and a face cap, which head assembly is rotatably mounted to the cylindrical tube such that the lamp bulb extends through a hole in the center of the reflector within the lens. In the principle embodiment of the present invention, the batteries are of the size commonly referred to as "pen light" batteries.

The head assembly engages threads formed on the exterior of the cylindrical tube such that rotation of a head assembly about the axis of the cylindrical tube will change the relative displacement between the lens and the lamp bulb. When the head assembly is fully rotated onto the cylindrical tube, the reflector pushes against the forward end of the lamp holder assembly causing it to shift rearward within the cylindrical tube against the urging of the spring contact at the tail cap. In this position, the electrical conductor within the lamp holder assembly which completes the electrical circuit from the lamp bulb to the cylindrical tube is not in contact with the tube. Upon rotation of the head assembly in a direction causing the head assembly to move forward with respect to the cylindrical tube, pressure on the forward surface of the lamp holder assembly from the reflector is relaxed enabling the spring contact in the tail cap to urge the batteries and the lamp holder assembly in a forward direction, which brings the electrical conductor into contact with the cylindrical tube, thereby completing the electrical circuit and causing the lamp bulb to illuminate. At this point, the lamp holder assembly engages a stop which prevents further forward motion of the lamp holder assembly with respect to the cylindrical tube. Continued rotation of the head assembly in a direction causing the head assembly to move forward relative to the cylindrical tube causes the reflector to move forward relative to the lamp bulb, thereby changing the focus of the reflector with respect to the lamp bulb, which results in varying the dispersion of the light beam admitted through the lens.

By rotating the head assembly until it disengages from the cylindrical tube, the head assembly may be placed, lens down, on a substantially horizontal surface and the tail cap and cylindrical tube may be vertically inserted therein to provide a miniature "table lamp."

DETAILED DESCRIPTION OF A PREFERRED EMBODIMENT

Figure 1:
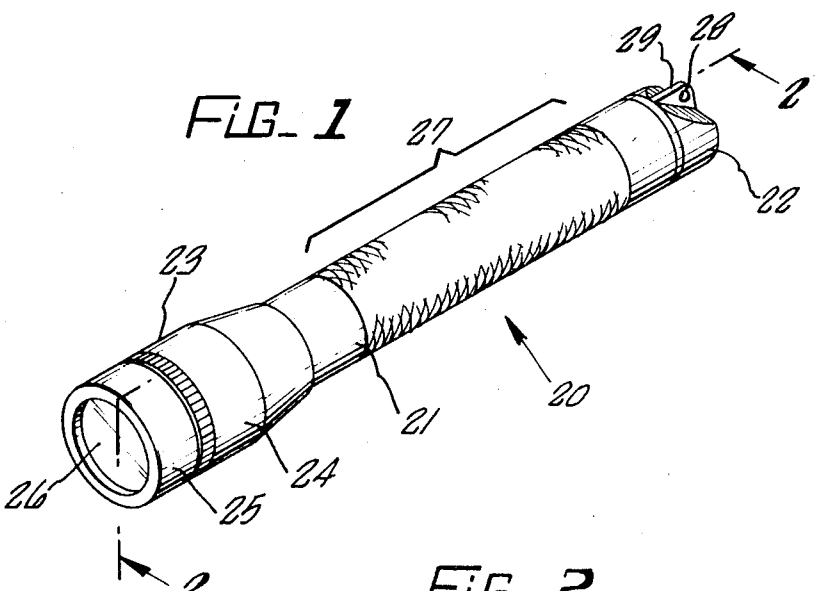
FIG. 1 is a perspective view of a miniature flashlight in accordance with the present invention.

Referring first to FIG. 1, a miniature flashlight in accordance with the present invention is illustrated in perspective generally at 20. The miniature flashlight 20 is comprised of a generally right circular cylinder, or barrel 21, enclosed at a first end by a tail cap 22 and having a head assembly 23 enclosing a second end thereof. The head assembly comprises a head 24 to which is affixed a face cap 25 which retains a lens 26. The head assembly 23 has a diameter greater than that of the barrel 21 and is adapted to pass externally over the exterior of the barrel 21. The barrel 21 may provide a machined handle surface 27 along its axial extent. The tail cap 22 may be configured to include provision for attaching a handling lanyard through a hole 28 in a tab 29 formed therein.

Figure 2:
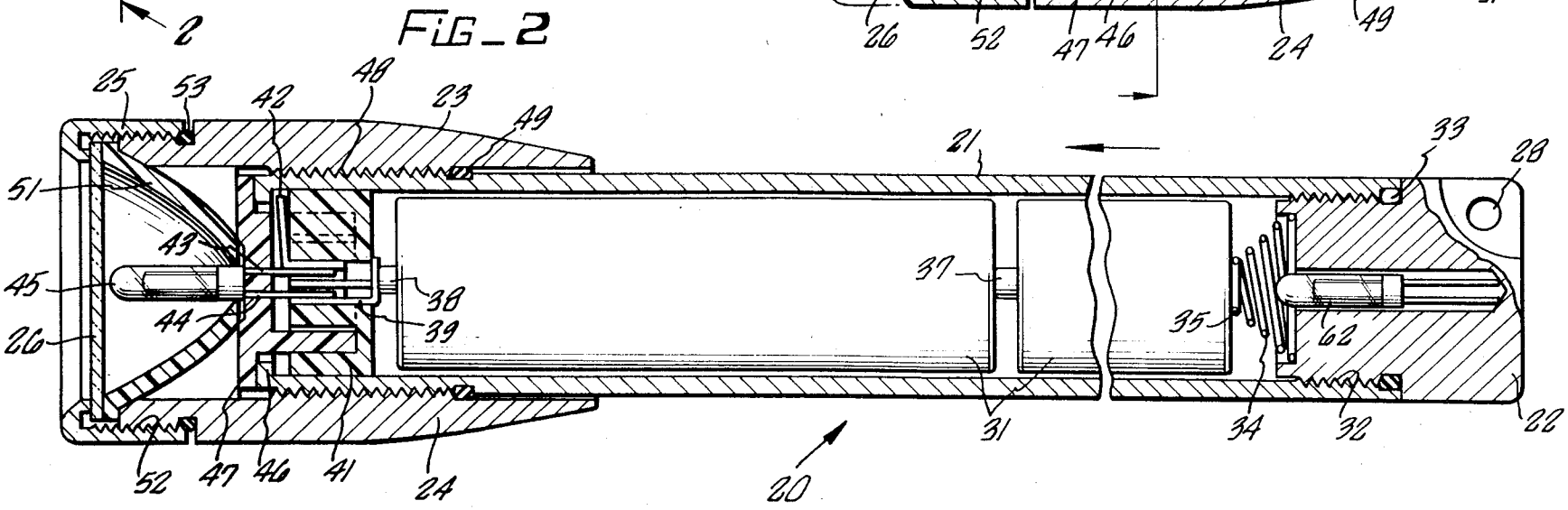
FIG. 2 is a partially foreshortened cross-sectional view of the miniature flashlight of FIG. 1 as taken through the plane indicated by 2—2.

Referring next to FIG. 2, the barrel 21 is seen to have an extent sufficient to enclose at least two miniature dry cell batteries 31 disposed in a series arrangement. The tail cap 22 has a region of external threading 32 which engages matching threads formed on the interior surface of the barrel 21. A sealing element 33, typically in the form of an O-ring, is provided at the interface between the tail cap 22 and the barrel 21 to provide a watertight seal. A spring member 34 is disposed within the barrel 21 so as to make electrical contact with the tail cap 22 and a case electrode 35 of an adjacent battery 31. The spring member 34 also urges the batteries 31 in a direction indicated by an arrow 36. A center electrode 37 of the rearmost battery 31 is in contact with the case electrode of the forward battery 31. The center electrode 38 of the forward battery is urged into contact with a first conductor 39 mounted within a lower insulator receptacle 41. The lower insulator receptacle 41 also has affixed therein a side contact conductor 42. Both the center conductor 39 and the side contact conductor 42 pass through holes formed in the lower insulator receptacle in an axial direction, and both are adapted to frictionally receive and retain the terminal electrodes 43 and 44 of a miniature bi-pin lamp bulb 45. Absent further assembly, the lower insulator receptacle is urged in the direction indicated by the arrow 36, by the action of the spring 34, to move until it comes into contact with a lip 46 formed on the end of the barrel 21. At that point electrical contact is made between the side contact conductor 42 and the lip 46 of the barrel 21.

An upper insulator receptacle 47 is disposed external to the end of the barrel 21 whereat the lower insulator receptacle 41 is installed. The upper insulator receptacle 47 has extensions that are configured to mate with the lower insulator receptacle 41 to maintain an appropriate spacing between opposing surfaces of the upper insulator receptacle 47 and the lower insulator receptacle 41. The lamp electrodes 43 and 44 of the lamp bulb 45 pass through the upper insulator receptacle 47 and into electrical contact with the center conductor 39 and the side contact conductor 42, respectively, while the casing of the lamp bulb 45 rests against an outer surface of the upper insulator receptacle 47.

The head assembly 23 is installed external to the barrel 21 by engaging threads 48 formed on an interior surface of the head 24 engaging with matching threads formed on the exterior surface of the barrel 21. A sealing O-ring 49 is installed around the circumference of the barrel 21 adjacent the threads to provide a water-tight seal between the head assembly 23 and the barrel 21. A substantially parabolic reflector 51 is configured to be disposed within the outermost end of the head 24, whereat it is rigidly held in place by the lens 26 which is in turn retained by the face cap 25 which is threadably engaged with threads 52 formed on the forward portion of the outer diameter of the head 24. An O-ring 53 may be incorporated at the interface between the face cap 25 and the head 24 to provide a water-tight seal.

When the head 24 is fully screwed onto the barrel 21 by means of the threads 48, the central portion of the reflector 51 surrounding a hole formed therein for passage of the lamp bulb 45, is forced against the outermost surface of the upper insulator receptacle 47, urging it in a direction counter to that indicated by the arrow 36. The upper insulator receptacle 47 then pushes the lower insulator receptacle 41 in the same direction, thereby providing a space between the forwardmost surface of the lower insulator receptacle 41 and the lip 46 on the forward end of the barrel 21. The side contact conductor 42 is thus separated from contact with the lip 46 on the barrel 21 as is shown in FIG. 2.

Figure 3:
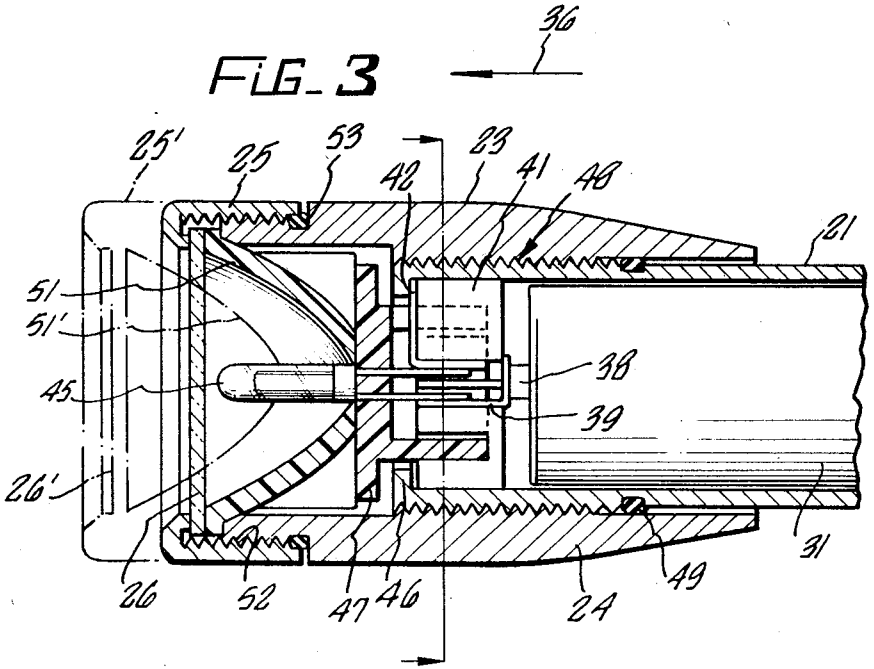
FIG. 3 is a partial cross-sectional view of a forward end of the miniature flashlight, illustrating, in ghost image, a translation of the forward end of the flashlight.

Referring next to FIG. 3, appropriate rotation of the head 24 about the axis of the barrel 21 causes the head assembly 23 to move in the direction indicated by the arrow 36 through the engagement of the threads 48. Upon reaching the relative positions indicated in FIG. 3 by the solid lines, the head assembly 23 has progressed a sufficient distance in the direction of the arrow 36 such that the reflector 51 has also moved a like distance, enabling the upper insulator receptacle 47 and the lower insulator receptacle 41 to be moved, by the urging of the spring 34 (FIG. 2) translating the batteries 31 in the direction of the arrow 36, to the illustrated position. In this position, the side contact conductor 42 has been brought into contact with the lip 46 on the forward end of the barrel 21, which closes the electrical circuit.

Further rotation of the head assembly 23 so as to cause further translation of the head assembly 23 in the direction indicated by the arrow 36 will result in the head assembly 23 reaching a position indicated by the ghost image of FIG. 3, placing the face cap at the position 25′ and the lens at the position indicated by 26′, which in turn carries the reflector 51 to a position 51′. During this operation, the upper insulator receptacle 47 remains in a fixed position relative to the barrel 21. Thus the lamp bulb 45 also remains in a fixed position. The shifting of the reflector 51 relative to the lamp bulb 45 during this additional rotation of the head assembly 23 produces a relative shift in the position of the filament of the lamp bulb 45 with respect to a focus of the parabola of the reflector 51, thereby varying the dispersion of the light beam emanating from the lamp bulb 45 through the lens 26.

Figures 4, 5, 6, 7, 8:
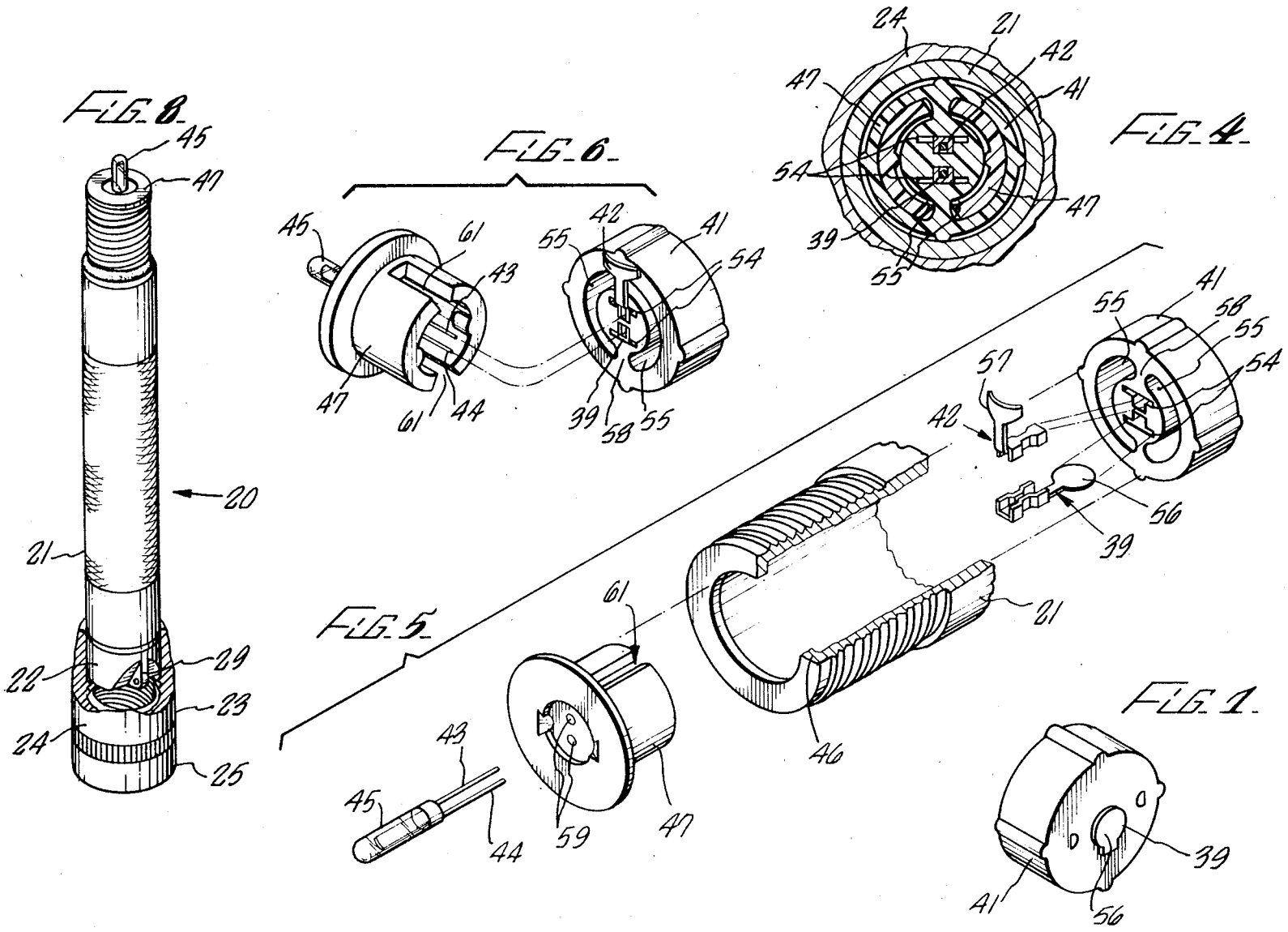
FIG. 4 is a partial cross-sectional view of a lamp bulb holder assembly used in accordance with the present invention, taken along the plane indicated by 4—4 of FIG. 3.
FIG. 5 is an exploded perspective view illustrating the assembly of the lamp bulb holder assembly with respect to a barrel of the miniature flashlight.
FIG. 6 is an isolated partial perspective view illustrating the electro mechanical interface between electrical terminals of the lamp bulb and electrical conductors within the lamp bulb holder.
FIG. 7 presents a perspective view of a rearward surface of the lamp bulb holder of FIG. 5, illustrating a battery electrode contact terminal.
FIG. 8 illustrates an alternate utilization of the miniature flashlight in accordance with the present invention.

Referring next to FIG. 4, a partial cross-sectional view illustrates the interface between the lower insulator receptacle 41 and the upper insulator receptacle 47. The lower insulator receptacle 41 has a pair of parallel slots 54 formed therethrough which are enlarged in their center portion to receive the center conductor 39 and the side contact conductor 42, respectively. A pair of arcuate recesses 55 are formed in the lower insulator receptacle 41 and receive matching arcuate extensions of the upper insulator receptacle 47. The lower insulator receptacle 41 is movably contained within the inner diameter of the barrel 21 which is in turn, at the location of the illustrated cross-section, enclosed within the head 24.

Referring next to FIGS. 5 through 7, a preferred procedure for the assembly of the lower insulator receptacle 41, the center conductor 39, the side contact conductor 42, the upper insulator receptacle 47 and the miniature lamp bulb 45 may be described. Placing the lower insulator receptacle 41 in a position such that the arcuate recesses 55 are directionally oriented towards the forward end of the barrel 21 and the lip 46, the center conductor 39 is inserted through one of the slots 54 such that a substantially circular end section 56 extends outwardly from the rear surface of the lower insulator receptacle 41. The circular end section 56 is then bent, as shown in FIG. 7, to be parallel with the rearmost surface of the lower insulator receptacle 41 in a position centered to match the center electrode of the forwardmost one of the batteries 31 of FIG. 2. The side contact conductor 42 is then inserted into the other slot 54 such that a radial projection 57 extends outwardly from the axial center of the lower insulator receptacle 41. It is to be noted that the radial projection 57 aligns with a web 58 between the two arcuate recesses 55.

The lower insulator receptacle 41, with its assembled conductors, is then inserted in the rearward end of the barrel 21 and is slidably translated to a forward position immediately adjacent the lip 46. The lamp electrodes 43 and 44 are then passed through a pair of holes 59 formed through the forward surface of the upper insulator receptacle 47 so that they project outwardly from the rear surface thereof as illustrated in FIG. 6. The upper insulator receptacle 47, containing the lamp bulb 45, is then translated such that the lamp electrodes 43 and 44 align with receiving portions of the side contact conductor 42 and the center conductor 39, respectively. A pair of notches 61, formed in the upper insulator receptacle 47, are thus aligned with the webs 58 of the lower insulator receptacle 41. The upper insulator receptacle 47 is then inserted into the arcuate recesses 55 in the lower insulator receptacle 41 through the forward end of the barrel 21.

Referring again to FIGS. 2 and 3, the electrical circuit of the miniature flashlight in accordance with the present invention will now be described. Electrical energy is conducted from the rearmost battery 31 through its center contact 37 which is in contact with the case electrode of the forward battery 31. Electrical energy is then conducted from the forward battery 31 through its center electrode 38 to the center contact 39 which is coupled to the lamp electrode 44. After passing through the lamp bulb 45, the electrical energy emerges through the lamp electrode 43 which is coupled to the side contact conductor 42. When the head assembly 23 has been rotated about the threads 48 to the position illustrated in FIG. 2, the side contact conductor 42 does not contact the lip 46 of the barrel 21, thereby resulting in an open electrical circuit. However, when the head assembly 23 has been rotated about the threads 48 to the position illustrated by the solid lines of FIG. 3, the side contact conductor 42 is pressed against the lip 46 by the lower insulator receptacle 41 being urged in the direction of the arrow 36 by the spring 34 of FIG. 2. In this configuration, electrical energy may then flow from the side contact conductor 42 into the lip 46, through the barrel 21 and into the tail cap 22 of FIG. 2. The spring 34 electrically couples the tail cap 22 to the case electrode 35 of the rearmost battery 31. By rotating the head assembly 23 about the threads 48 such that the head assembly 23 moves in a direction counter to that indicated by the arrow 36, the head assembly 23 may be restored to the position illustrated in FIG. 2, thereby opening the electrical circuit and turning off the flashlight.

Referring next to FIG. 8, an additional utilization of the miniature flashlight 20 in accordance with the present invention is illustrated. By rotating the head assembly 23 about the threads 48 in a direction causing the head assembly 23 to translate relative to the barrel 21 in the direction of the arrow 36 of FIG. 3, the electrical circuit will be closed as previously described, and the lamp bulb 45 will be illuminated. Continued rotation of the head assembly 23 in that direction enables the head assembly 23 to be completely removed from the forward end of the miniature flashlight 20. By placing the head assembly 23 upon a substantially horizontal surface (not illustrated) such that the face cap 25 rests on the surface, the tail cap 22 of the miniature flashlight 20 may be inserted into the head 24 to hold the barrel 21 in a substantially vertical alignment. Since the reflector 51 (FIG. 2) is located within the head assembly 23, the lamp bulb 45 will omit a substantially spherical illumination, thereby providing a "ambient" light level.

In a preferred embodiment, the barrel 21, the tail cap 22, the head 24, and the face cap 25, forming all of the exterior metal surfaces of the miniature flashlight 20 are manufactured from aircraft quality, heat-treated aluminum, which is annodized for corrosion resistance. The sealing O-rings 33, 49, and 53 provide atmospheric sealing of the interior of the miniature flashlight 20 to a depth of 200 feet. All interior electrical contact surfaces are appropriately machined to provide efficient electrical conduction. The reflector 51 is a computer generated parabola which is vacuum aluminum metallized to ensure high precision optics. The threads 48 between the head 24 and the barrel 31 are machined such that revolution of the head assembly 23 through less than $\frac{1}{4}$ turn will close the electrical circuit, turning the flashlight on, and an additional $\frac{1}{4}$ turn will adjust the light beam from a "spot" to a "soft flood". A spare lamp bulb 62 may be provided in a cavity machined in the tail cap 22.

While I have described a preferred embodiment of the herein invention, numerous modifications, alterations, alternate embodiments, and alternate materials may be contemplated by those skilled in the art and may be utilized in accomplishing the present invention. It is envisioned that all such alternate embodiments are considered to be within the scope of the present invention as defined by the appended claims.

I claim:

1. A miniature flashlight comprising:

means for retaining a plurality of miniature dry cell batteries in series electrical contact;

a miniature bi-pin lamp bulb;

means for holding the miniature bi-pin lamp bulb, said means being movably retained by the means for retaining a plurality of dry cell batteries;

a substantially parabolic reflector;

a substantially planar lens;

means for retaining the reflector and the lens in a mutually fixed relationship, said means for retaining the reflector and the lens being adapted to be controllably translatable along the means for retaining a plurality of dry cell batteries such that the relative positional relationship between the reflector and the lamp bulb may be varied, thereby varying a reflection dispersion of a light beam emanating through the lens from said miniature bi-pin lamp bulb;

means for electrically coupling a first electrode of the series arranged dry cell batteries to a first pin of the bi-pin lamp bulb; and means for electrically coupling a second pin of the bi-pin lamp bulb to a second electrode of the series arranged dry cell batteries;

wherein relative motion of the means for retaining the reflector and the lens in a direction toward the means for retaining a plurality of miniature dry cell batteries will cause the reflector to contact the means for holding the miniature bi-pin lamp bulb and further relative motion in the same direction will move the means for holding the miniature bi-pin lamp bulb to open an electrical contact at the means for electrically coupling the second pin of the bi-pin lamp bulb to the second electrode of the batteries.

2. A miniature flashlight, comprising:

a barrel containing a pair of miniature dry cell batteries in series electrical contact, said barrel having a first end and a second end, and having a radially inwardly directed annular lip formed at the second end;

a tail cap, including a spring member, threadably engaging with the barrel at the first end thereof, the spring member urging the dry cell batteries toward the second end of the barrel;

a head assembly, including a light transmitting lens and a beam forming reflector, threadably engaging a radially exterior surface of the barrel at the second end of the barrel, said reflector having a central hole formed therein adapted to enable the passage of a miniature lamp bulb there-through;

a first insulated receptacle, disposed within the barrel between the batteries and the lip formed at the second end of the barrel;

a center conductor member passing through the first insulated receptacle in an axial direction so as to be in electrical contact with a center electrode of the proximate battery;

a side conductor member mounted in the first insulated receptacle in a spaced apart relationship with the center conductor member, the side conductor member having a radially outwardly extending arm disposed between the lip formed on the second end of the barrel and a surface of the first insulated receptacle, said outwardly extending arm being spaced apart from an inner diameter of the barrel;

a second insulated receptacle disposed external to the second end of the barrel, mechanically engaging the first insulated receptacle, said second insulated receptacle being disposed within the head assembly but not mechanically coupled thereto; and a miniature bi-pin lamp bulb mounted to the second insulated receptacle such that the pins thereof pass through the second insulated receptacle and are electrically coupled to the center conductor member and the side conductor member, respectively;

said threadable engagement of the head assembly to the barrel providing that the head assembly may translate axially with respect to the barrel to vary the position of the reflector with respect to the miniature lamp bulb, thereby providing a change in focus of a light beam emanating from the lamp bulb; and whereby further translation of the head assembly along the barrel toward the tail cap will first cause the reflector to contact the second insulated receptacle and then move the second insulated receptacle, the first insulated receptacle, and the batteries against the urging of the spring member so as to separate the radially outwardly extending arm of the side conductor member from the lip formed on the second end of the barrel, thereby interrupting the electrical circuit of the miniature flashlight.

3. A miniature flashlight, comprising:

a barrel, configured as an extended right circular cylinder, open at each end, having internal threads formed in a first end and external threads formed on a second end, and having a radially inwardly extending annular lip formed at the second end;

a tail cap, adapted to threadably engage with the first end of the barrel, the tail cap being further adapted to retain a spare miniature lamp bulb;

a first insulated receptacle, disposed within the barrel adjacent the lip formed at the second end thereof;

a center contact conductor passing through the first insulated receptacle in a direction parallel with a longitudinal access of the barrel;

a side contact conductor mounted in a surface of the first insulated receptacle proximate to the lip of the barrel, and having a radially outwardly extending arm disposed between the lip and the surface of the first insulated receptacle;

said center contact conductor and said side contact conductor being spaced apart equidistant from the axial center of the barrel;

a pair of miniature dry cell batteries disposed in a series arrangement within the barrel so as to be between the first insulated receptacle and the tail cap, the batteries being so oriented that their respective center electrodes face the second end of the barrel, with the center electrode of the dry cell most proximate to said second end of the barrel being in electrical contact with the center contact conductor;

a spring member disposed between the tail cap and the battery most proximate to the first end of the barrel so as to urge the batteries toward the second end of the barrel, the spring member serving as an electrical conductor between the tail cap and a case electrode of the battery;

a second insulated receptacle disposed external to the second end of the barrel so as to matingly engage the first insulated receptacle;

a bi-pin lamp bulb, held by the second insulated receptacle such that its two pins pass therethrough and into contact with the center contact conductor and side contact conductor, respectively;

a head member, configured generally as a right circular cylinder open at both ends, threadably engaging the exterior of the second end of the barrel;

a reflector member, having a substantially parabolic shape, disposed within the head member, the reflector member having a hole formed therein substantially at its apex through which the bi-pin lamp bulb may pass;

a substantially circular transparent planar lens element, the lens element retaining the reflector member within the head member; and a face cap, configured as a substantially annular ring, threadably engaging with the head member, the face cap being adapted to rigidly retain the lens element and the reflector member between the face cap and the head member;

whereby full threadable engagement of the head member onto the barrel causes the apex region of the reflector member to come into contact with and translate the second insulated receptacle, together with the first insulated receptacle and the dry cell batteries within the barrel against the urging of the spring member, which translation displaces the radially outwardly extending arm of the side contact conductor from physical contact with the lip at the second end of the barrel, thereby opening an electrical circuit of the miniature flashlight.

4. In a miniature flashlight providing for a continuous variation in the dispersion of a lightbeam emanating therefrom through a relative axial motion between a head assembly, containing a reflector, and a barrel assembly, containing a plurality of miniature dry cell batteries and supporting a miniature lamp bulb, the improvement comprising:

a first insulated receptacle, disposed within the barrel between the batteries and the lamp bulb, the first insulated receptacle being removably retained within the barrel;

a center conductor element passing through the first insulated receptacle in an axial direction so as to be in electrical contact with an electrode of the proximate battery;

a side conductor member mounted in the first insulated receptacle in a spaced apart relationship with the center conductor member, the side conductor member having a radially outwardly extending arm disposed between a surface of the first insulated receptacle and a lip formed on the end of the barrel retaining the first insulated receptacle, said outwardly extending arm being spaced apart from an inner diameter of the barrel; and a second insulated receptacle disposed external to the end of the barrel, mechanically engaging the first insulated receptacle, said second insulator receptacle being exposed within the head assembly but not mechanically coupled thereto;

whereby translation of the head assembly along the barrel in a direction engaging the head assembly with the barrel will first cause the reflector within the head assembly to contact the second insulated receptacle and then move the second insulated receptacle and the first insulated receptacle in that direction so as to separate the radially outwardly extending arm of the side conductor member from the lip on the end of the barrel, thereby interrupting the electrical circuit of the miniature flashlight; and whereby translation of the head assembly along the barrel in a direction tending to disengage the head assembly from the barrel will first allow the first insulated receptacle and the second insulated receptacle to follow the motion of the reflector until the radially outwardly extending arm of the side conductor member contacts the lip formed on the end of the barrel, thereby closing the electrical circuit of the miniature flashlight.

* * * * *